United States Patent [19]

Lee

[11] Patent Number: 4,799,280

[45] Date of Patent: Jan. 24, 1989

[54] MOTOR DRIVEN ROTARY BRUSH

[76] Inventor: Fu-Kuei Lee, P.O. Box 10780, Taipei, Taiwan

[21] Appl. No.: 733

[22] Filed: Jan. 5, 1987

Related U.S. Application Data

[63] Continuation-in-part of Ser. No. 764,628, Aug. 12, 1985, abandoned.

[51] Int. Cl.[4] ..... A46B 13/04

[52] U.S. Cl. ..... 15/29

[58] Field of Search ..... 15/23, 24, 28, 29, 97 R

[56] References Cited

U.S. PATENT DOCUMENTS

| | | | |
|---|---|---|---|
| 1,625,792 | 4/1927 | Carrington | 15/29 |
| 2,651,795 | 9/1953 | Kilgore | 15/29 |
| 2,744,271 | 5/1956 | Florence | 15/29 |
| 4,168,560 | 9/1979 | Doyel | 15/29 |

FOREIGN PATENT DOCUMENTS

| | | | |
|---|---|---|---|
| 1405404 | 5/1965 | France | 15/24 |

*Primary Examiner*—Edward L. Roberts

[57] ABSTRACT

This invention is a motor rotary device having a pump to enhance pressure of water passing through the interior compartment of the brush. The water, while flowing through a water pipe, is allowed to mix with fluid additive and then flow out from the center portion of the brush. There is a pump located at the water pipe. When the motor rotates in a certain direction, it will allow a moveable sliding shaft to slide to a certain position to move a set of idle gears and make the pump rotate to enhance the water pressure of water pipe's water.

1 Claim, 3 Drawing Sheets

FIG.2
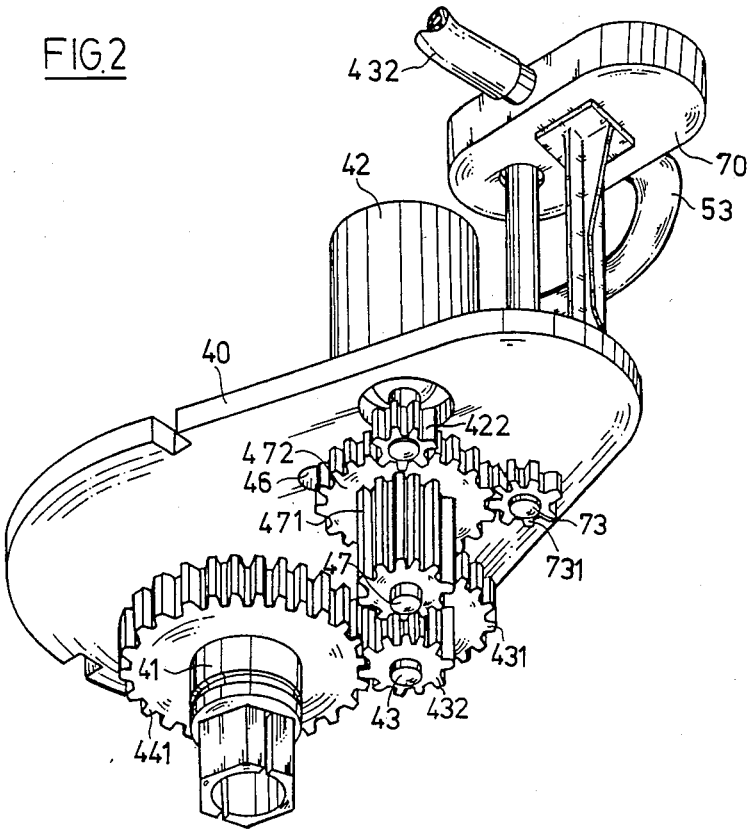
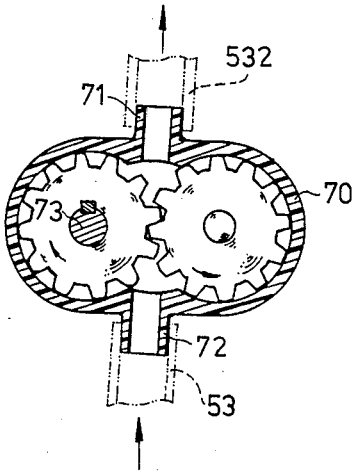
FIG.6

MOTOR DRIVEN ROTARY BRUSH

This application is a continuation-in-part of Ser. No. 764,628 filed on Aug. 12, 1985, and now abandoned.

BRIEF SUMMARY OF THE INVENTION

A motor driven rotary brush includes a motor, a set of idle gears with a sliding shaft, a main water tube extending to the center portion of brush via a pump. When motor is started to run in a certain direction, sliding shaft is pushed to a certain end of the track formed by a slide way so as to engage two related gears to run the pump and the brush. Water flowing through the pump will therefore be pressured and sprayed out from the brush.

BACKGROUND OF THE INVENTION

This invention relates to a motor drive rotary brush with a container for putting a fluid additive into the water pipe, such as fluid detergent or the like, so as to mix with water and flow out via a hollow rotating shaft from the center portion of the brush. The motor can be run in clockwise or counter-clockwise direction by the control of a switch. A moveable slide shaft may be moved to a certain position according to the direction of motor's rotating and allow those pertinent gears to engage with each other so as to permit a pump rotating by the power supply from the motor and to enhance the water pressure. The idea of this invention occured while I was using my original invention Ser. No. 764,628 to do cleaning work such as washing cars or window. I thought if the water pressure of the brush was enhanced, it should be more convenient and faster to finish the cleaning work and reduce the user's physical strength.

In order to achieve the purpose, except maintaining the equipment and the hollow interior compartment of the original invention Ser. No. 764,628, a pump and a set of moveable idle gears are installed on the support plate which supports the motor, speed reduction gear, and output rotating shaft and etc. A water tube first is connected to the inlet of the pump and then connect to the water inlet pipe at the upper portion of the brush's rotating shaft through the outlet of the pump.

Therefore, while beginning the cleaning work, the user may turn on the motor switch to allow the motor to change the rotating direction and the set of idle gear which will automatically move the position along with a track formed by a slide way and drive the pump and the revolving shaft to rotate concurrently. Thus, while water flowing out from the center portion of the brush, the water pressure will be enhanced and a convenient rotary brush can be obtained.

BRIEF DESCRIPTION OF THE DRAWINGS

FIG. 2 is a partial perspective bottom view showing pump and reduction gears installed on the support plate.

FIG. 6 is a sectional view of pump of this invention.

DETAILED DESCRIPTION OF THE INVENTION

Figure 1:
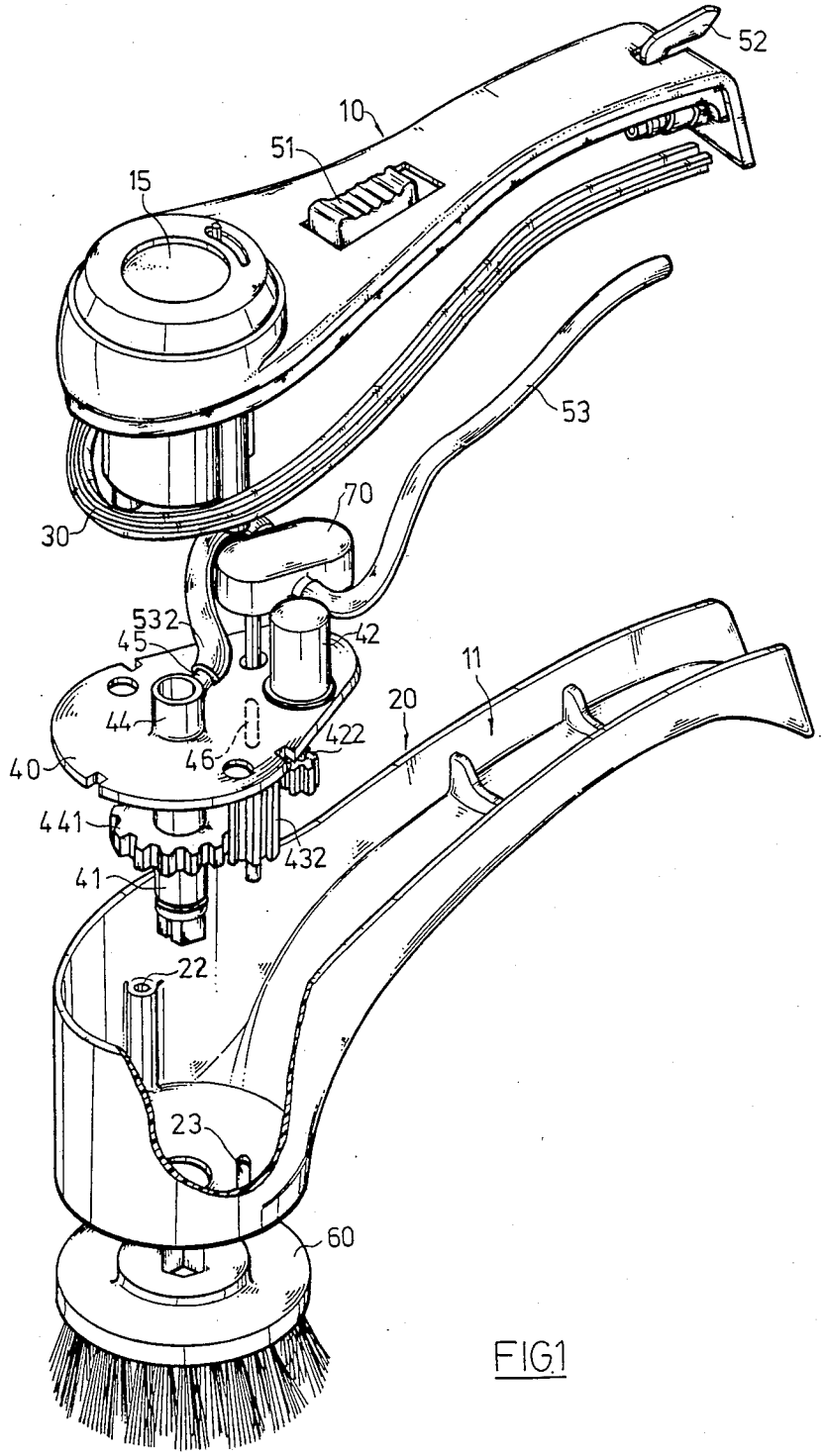
FIG. 1 is a disassembled isometric view of this invention.

This invention consists of a moveable and combineable upper casing 10 and lower casing 20 to form a interior compartment 11. A seal 30 is mounted around the casing joint serving as a waterproof device for the compartment. The support plate 40, is mounted on the internal front shoulder 22 of the lower casing 20 and is equipped with an tube joint Y-shaped. There are two liquid inlets 44 and 45 located at the upper portion of the support plate; one is water tube 45 connecting with the outlet 71 of pump 70, and the other is fleeding tube 44 connecting with the outlet of container 15. The structure of the container 15, referred to my original application Ser. No. 764,628 functions as a container for fluid detergent or fluid wax with a switch for controlling the flow. The fluid additive, after mixing with water, will flow through the interior portion of a hollow rotating shaft 41, and the center portion of the brush.

In addition to the motor 42, a pump 70 and rotating shaft 41 are also fixed on the support plate 40. A slide way 46 is positioned between these fittings. The slide way 46 runs parallel with the other corresponding slide way 23 of shell 20. Both slide ways 46 and 23 are formed as a slide way for installing a shaft 47 with two different gears 471 and 472 which commonly form a moveable idle gear means. Gear 472 of shaft 47 is always engaged with the drive gear 422 of motor 42. A idle gear means which is mounted on the support plate 40 is formed by two idle gears 431 and 432 secured on the idle shaft 43 wherein the gear 432 is permanently engaged with the gear 441 of the rotating shaft 41. This mechanical driving system is clearly shown on FIG. 3 and FIG. 4.

Figure 3:
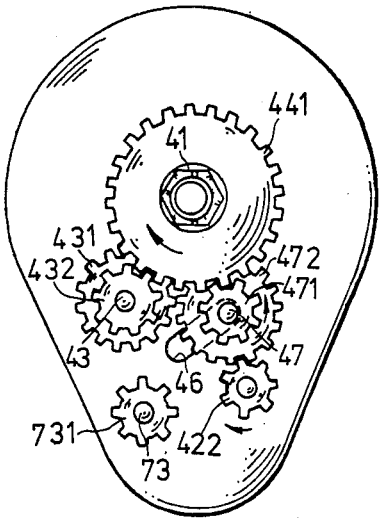
FIG. 3 is a assembly view for the gearing system with pump in non-driving position.

FIG. 3 illustrates the driving motion of brush 60. A drive gear 422 of motor 42 runs in clockwise direction, as viewed in FIG. 3, with the shaft 47 positioned at the right end of sliding track and with the gear 471 of the shaft 47 engaged with the gear 441 which is fixed on the hollow rotating shaft 41. With gear 422 engaged with gear 472, the gear 471 drives the gear 441 and rotates shaft 41 in a clockwise direction. Idle shaft 43 is idling at this time.

Figure 4:
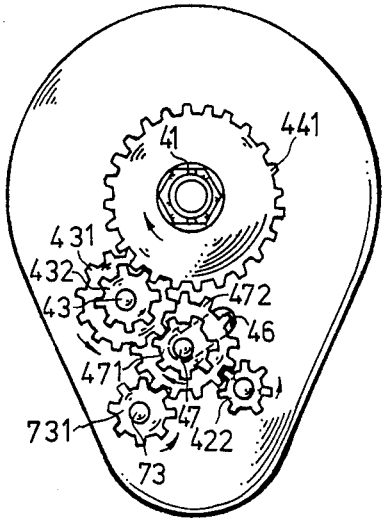
FIG. 4 is a assembly view for the gearing system with pump in a driving position.

FIG. 4 illustrates the synchronized operation of pump 70 and brush 60. When power switch 51 has been shifted to another step, the motor 42 is allowed to run in counter-clockwise direction, as viewed in FIG. 4, and to push the shaft 47 of the movable idle gear means along the track of sliding ways 46 and 23 to the left end of sliding track, therefore, gear 472 is engaged with the gear 731 which is in the shaft end of pump shaft 73. At the same time, the gear 471 of shaft 47 engages the gear 431 of idle shaft 43, and the gear 432 being engaged with gear 441, rotates shaft 41 to rotate together with the brush 60 in a clockwise direction as viewed in FIG. 4. As FIG. 6 shows, shaft 73 of pump 70 is driven by motor 42 via the same gearing system and also rotate in counter-clockwise direction, as viewed in FIG. 6, to squeeze water from intake 72 to outlet 71 where water flows from the faucet 52 to water tube 45 via tube 53, intake 72, pump 70, outlet 71 and tube 532.

According to the statement above, when motor 42 is operated to rotate in clockwise direction it will allow the brush 60 to rotate as a handy tool for polishing purpose, and when motor 42 is operated to rotate in counter-clockwise direction by means of putting the switch 51 located at the upper casing to another position it will drive both pump 70 and brush 60 to rotate at the same time. Thus, flowing water at this moment will then be pressured to spray out from the brush 60 and intensify the flushing power for cleaning work.

Figure 5:
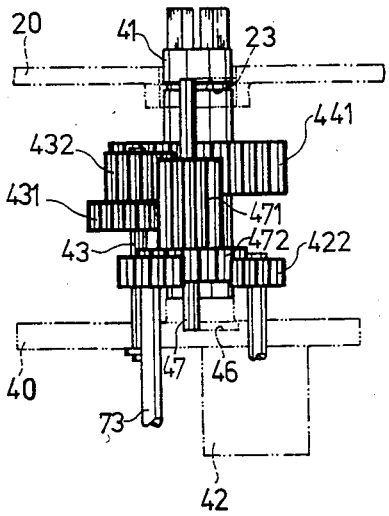
FIG. 5 is a bottom side view of FIG. 4.

To achieve the cleaning work in a short time by increasing water spray function, this invention needs not to attach any power equipment, or any complicated backup device to increase power. In FIG. 5, the main mechanical structure illustrates that both ends of the moveable shaft 47 are installed within two slide ways 46 and 23 of support plate 44 and the lower casing and are able to shift to the either ends of sliding track by the direction of rotation of motor 42. Furthermore, the pump will enhance the liquid pressure by a pump shaft 73. While the invention has been described with reference to details of the illustrated embodiments, such details are not intended to limit the invention as defined in the appended claims.

I claim:

1. A motor driven rotary brush comprising:

a casing having upper and lower portions forming a hollow interior compartment;

a support plate mounted in said compartment and having a slide way formed as a track;

motor means and first idle gear means mounted on said support plate, said motor means including switch means to control the revolving direction of said motor means;

a pump means having a shaft and mounted on said support plate and having a gear mounted on the shaft end;

a hollow shaft mounted in said lower portion and having an upper end and a lower end, a gear fixed on said upper end and in engagement with said first idle gear means, and said lower end extending outside of said lower portion;

a moveable idle gear means having plural gears and mounted on a shaft positioned in the slide way formed by the slide way in the support plate and a cooperating slide way in the lower portion of the casing, said movable idle gear means being in driving engagement with said motor means and adapted to be moved to a certain position according to the revolving direction of said motor and allowing the plural gear to engage the gear of said pump means and another of said plural gears to engage a gear of said first idle gear means, or moved to another position that solely engages the gear of said hollow shaft;

a pipe means in said casing extending to said pump means and from said pump means to said hollow shaft;

a water supply means coupled to said casing and connected to said pipe means to discharge water through said hollow shaft, said water supply means having valve means to control the flow therethrough;

an additive container mounted on the upper casing portion, said container having means to discharge additive from said container to said pipe means to mix said additive with said water prior to discharge from said hollow shaft, said means to discharge including outlet means from the container and valve means to control said outlet means; and a brush mounted on the lower end of said hollow shaft, said brush having a central opening mounting said brush on said hollow shaft and providing means for passage of water and additive through said brush to a work surface.

* * * * *